US008102268B2

(12) United States Patent
Arrighi

(10) Patent No.: US 8,102,268 B2
(45) Date of Patent: Jan. 24, 2012

(54) MACHINE WASHABLE ID LABEL

(75) Inventor: Robert Arrighi, Maplewood, NJ (US)

(73) Assignee: Union Tool & Mold Company, Maplewood, NJ (US)

( * ) Notice: Subject to any disclaimer, the term of this patent is extended or adjusted under 35 U.S.C. 154(b) by 509 days.

(21) Appl. No.: 12/386,863

(22) Filed: Apr. 25, 2009

(65) Prior Publication Data

US 2010/0271211 A1 Oct. 28, 2010

(51) Int. Cl.
*G08B 13/14* (2006.01)

(52) U.S. Cl. ..... 340/572.8; 340/572.1; 340/568.1; 340/571

(58) Field of Classification Search ..... 340/572.8, 340/572.1, 568.1, 571; 70/57, 57.1; 235/492
See application file for complete search history.

(56) References Cited

U.S. PATENT DOCUMENTS

| | | | |
|---|---|---|---|
| 5,717,382 | A | 2/1998 | Cooper |
| 5,949,336 | A | 9/1999 | Deschenes et al. |
| 6,064,306 | A | 5/2000 | Deschenes et al. |
| 6,067,016 | A | 5/2000 | Deschenes et al. |
| 6,488,531 | B1 | 12/2002 | Kolton et al. |
| 6,518,888 | B1 | 2/2003 | Kolton et al. |
| 6,543,261 | B2 | 4/2003 | Kolton et al. |
| 6,567,003 | B2 | 5/2003 | Kolton et al. |
| 6,589,067 | B1 | 7/2003 | Kolton et al. |
| 6,646,553 | B1 | 11/2003 | Kolton et al. |
| 6,696,955 | B2 | 2/2004 | Kolton et al. |
| 6,753,779 | B1 | 6/2004 | Kolton et al. |
| 6,882,277 | B2 | 4/2005 | Kolton et al. |
| 6,899,252 | B2 | 5/2005 | Logan et al. |
| 6,932,251 | B2 | 8/2005 | Kolton et al. |
| 6,933,847 | B2 | 8/2005 | Feibelman |
| 6,987,455 | B2 | 1/2006 | Kolton et al. |
| 7,005,989 | B2 | 2/2006 | Benoit et al. |
| 7,012,526 | B2 | 3/2006 | Kolton et al. |
| 7,095,327 | B2 | 8/2006 | Kolton et al. |
| 7,129,841 | B2 | 10/2006 | Feibelman |
| 7,183,914 | B2 | 2/2007 | Norman et al. |
| 7,183,927 | B2 | 2/2007 | Kolton et al. |
| 7,227,467 | B2 | 6/2007 | Feibelman |
| 2006/0145873 | A1 | 7/2006 | Feibelman et al. |

*Primary Examiner* — Jennifer Mehmood
*Assistant Examiner* — Hongmin Fan
(74) *Attorney, Agent, or Firm* — Kenneth P. Glass, Esq.; Deirdra M. Meagher, Esq.

(57) ABSTRACT

A machine-washable ID label for attachment to a washable item includes: a) an outer shell for housing an electronic article surveillance element, with a first component and a second component, the first component being a hollow component with a bottom and side walls, the walls having inside surfaces and outside surfaces and a continuous loop rim, the first component having a U-shaped view from a cut side view and from a cut end view, the first component having an outwardly extending male connector on the rim, and the second component being a hollow component with a top and side walls, the walls having inside surfaces and outside surfaces and a continuous loop rim, the first component having a U-shaped view from a cut side view and from a cut end view, the first component having an inwardly extending female connector receiver on the rim, wherein the male connector is located in the female connector receiver and the first component and the second component are hermetically sealed to one another so as to render the inside of the outer shell internally waterproof, wherein at least one of the first component and the second component has an embedded seal energy director; and b) an electronic article surveillance element positioned within the outer shell so as to render it impermeable to water.

20 Claims, 2 Drawing Sheets

MACHINE WASHABLE ID LABEL

BACKGROUND OF INVENTION a. Field of Invention

The invention relates generally to a washable ID label that is an anti-theft device that may be inserted into or attached to washable items, e.g., by being sewn in or otherwise attached to the washable item. The invention relies upon a combination of an EAS (Electronic Article Surveillance) marker (sometimes referred to as an anti-theft tag), and a unique outer shell that is designed and sealed so as to render the tag washable. By doing this, there is no need to remove the ID label when a garment, rug or other item is to be washed. It eliminates the step of removal for the seller of products containing the present invention ID labels.

b. Description of Related Art

The following patents are representative of the field pertaining to the present invention:

U.S. Pat. No. 7,227,467 B2 to Feibelman describes an anti-theft security tag that includes an engagement member having a first and second end that is securable within a housing by a crimping member for attachment to an article. In one embodiment, the housing supports an electronic article surveillance marker and may include a channel for receiving and securing at least one self-crimping member. The self-crimping member is sized to receive one end of the engagement member. The one or more crimping members may be disc shaped, including a plurality of fingers for securing one end of the engagement member, or may have a variety of other shapes. The self-crimping members allow the engagement member to be moved downward, but not upward, so as to make the engagement loop smaller. In another embodiment, the crimping member is manual and a slot is disposed within the housing in alignment with at least one crimping member, and is sized to receive a crimping tool to crimp the member and secure the line to the article within the housing.

U.S. Pat. No. 7,183,927 B2 to Kolton et al. describes an electronic surveillance assembly that comprises a housing containing an electronic article surveillance marker, the housing defining a viewability channel extending between opposed first and second exterior surfaces of the housing, the electronic article surveillance marker being disposed aside the viewability channel. In a combination, there is provided an article of manufacture and an electronic article surveillance assembly comprising a housing containing an electronic article surveillance marker, the housing defining a viewability channel extending between opposed first and second exterior surfaces of the housing, the electronic article surveillance marker being disposed aside the viewability channel, the article of manufacture having a bottom portion thereof disposed in the housing in registry with the viewability channel.

U.S. Pat. No. 7,183,914 B2 to Norman et al. describes a hang tag which provides for the accommodation of electronic article surveillance (EAS) marker. The hang tag includes a housing for supporting the EAS marker therein. A securement head is provided for accommodating a securement strap for coupling the housing to an article that is to be protected. The head is coupled to the housing in such a fashion that it permits continuous rotation with respect to the housing to thwart and attempt to improperly sever the securement strap from the article.

U.S. Pat. No. 7,129,841 B2 to Feibelman describes an adjustable anti-theft security tag that includes an engagement member having a first and second end securable within a housing for attachment to an article. The housing supports an electronic article surveillance marker and may include one or more channels for receiving and securing at least one stationary crimping member. The at least one stationary crimping member is sized to receive one end of the engagement member. The one or more crimping members may be disc shaped, including a plurality of fingers for securing one end of the engagement member, or may be tubular. The disc shaped members allow the engagement member to be moved downward, but not upward, so as to make the engagement loop smaller. In one embodiment, a slow is disposed within the housing in alignment with the at least one crimping member, and is sized to receive a crimping tool to crimp the member and secure the line to the article within the housing.

U.S. Pat. No. 7,095,327 B2 to Kolton et al. describes an electronic article surveillance assembly that comprises an upstanding housing having a closed ceiling and a floor having continuous peripheral portion bounding a central floor opening, the housing having an interior cavity communicating with the central floor opening, an EAS marker being disposed in the housing interior cavity, the housing defining a side wall extending from the ceiling to the continuous peripheral floor portion and tapered to form the housing with a periphery having a V-shaped cross-section. Further provided is, in combination, an electronic article surveillance assembly comprising an upstanding housing having a closed ceiling and a floor having a continuous peripheral portion bounding a central floor opening, the housing having an interior cavity communicating with the central floor opening, an EAS marker being disposed in the housing interior cavity, the housing defining a side wall extending from the ceiling to the continuous peripheral floor portion and tapered to form the housing with a periphery having a V-shaped cross-section and an article of manufacture, the continuous floor peripheral portion being secured to an exterior surface of the article manufacture.

U.S. Pat. No. 7,012,526 B2 to Kolton et al. described an EAS marker assembly that comprises a housing defining a cavity extending inwardly from an open wall of the housing and a passage extending through a closed wall of the housing opposite the open wall and disposed aside the cavity and an EAS marker secured to the closed wall of the housing. A securement member extends through the passage and secures the EAS marker assembly to an article of manufacture, the article of manufacture closing the open wall of the housing.

U.S. Pat. No. 7,005,989 B2 to Beniot et al. describes an EAS marker, in one embodiment, comprises a self-lockable loop fastener. The self-lockable loop fastener comprises an elongated strap having a first end and a second end, the second end being provided with a plurality of teeth. The self-lockable loop fastener also comprises a paddle disposed at the first end of the strap. The paddle includes a recess and a locking head. The second end of the strap is insertable into, but not through the locking head, the locking head having a tang for lockably engaging the teeth in such a way as to prevent withdrawal of the strap from the locking head and thereby forming a locked loop of fixed size. The EAS marker also includes a resonator disposed within the recess of the paddle for emitting, when armed, a response signal in response to an interrogation signal transmitted by an EAS system, a biasing element disposed within the recess and positioned relative to the resonator so that, when the biasing element is magnetized, the resonator is armed; a separator disposed within the recess between the resonator and the biasing element; and a cover secured to the paddle to encapsulate the resonator, the separator and the biasing element within the recess and to prevent access to and tampering with the tang and the locking head.

U.S. Pat. No. 6,987,455 B2 to Kolton et al. describes an assembly which includes an article of manufacture having an exterior surface of a given color and an EAS marker-containing housing secured to the article and defining an exterior surface of the given color. Another assembly includes an article of manufacture having an exterior surface with a surface section of a given configuration and an EAS marker-containing housing secured to the article and defining an exterior surface having surface section contiguous with the article surface section and of the given configuration.

U.S. Pat. No. 6,933,847 to Feibelman describes an anti-theft security tag that includes an engagement member having a first and second end securable within a housing for attachment to an article. The housing supports an electronic article surveillance marker and may include one or more channels for receiving and securing at least one crimping sleeve. The at least one crimping sleeve is sized to receive one end of the engagement member. A slot is disposed within the housing in alignment with the at least one crimping sleeve, and is sized to receive a crimping tool to crimp the sleeve and secure the wire to the article within the housing.

U.S. Pat. No. 6,932,251 B2 to Kolton et al. describes a hanger that has a support rod engaging portion, a garment supporting portion extending downwardly of the support rod engaging portion and a size marker receiving portion opening into the periphery of the hanger, the hanger defining in the size marker receiving portion at least one deflectable size marker retaining member. A size marker for assembly with a hanger includes a rigid body defining a ceiling and front and rear walls extending downwardly of the ceiling to a floor, at least one passage opening into the floor and extending between the front and rear walls, the recess communicating with the passage at an upper portion thereof.

U.S. Pat. No. 6,899,252 B2 to Logan et al. describes a separator that is insertable into a medicine container and thereupon defining upper and lower compartments in the medicine container, the separator having a separating portion pivotally supported for movement into a first position for forming the upper and lower compartments and into a second position providing access to the lower compartment, the separator including latching structure for releasably maintaining the separator portion in the first position.

U.S. Pat. No. 6,882,277 B2 to Kolton et al. describes an EAS marker assembly that comprises of a housing defining an interior cavity and an EAS marker contained in the housing interior cavity, the housing defining first and second tabs extending outwardly of the housing, each of the first and second tabs defining an aperture extending therethrough. The EAS marker assembly is assembled with an article of manufacture defining first and second apertures extending therethrough, the EAS marker assembly being arranged in combination with the article of manufacture such that the apertures of the first and second tabs are aligned with the first and second apertures of the article of manufacture and a joinder device extending through the apertures of the first and second tabs and the first and second apertures of the article of manufacture and securing the EAS marker assembly to the article of manufacture.

U.S. Pat. No. 6,753,779 B1 to Kolton et al describes an electronic article surveillance assembly that comprises a housing defining an interior compartment, an electronic article surveillance marker secured in the interior compartment, and a securement device insertable in the housing and having securement structure extending outwardly of the housing for attaching the housing to an article of manufacture.

U.S. Pat. No. 6,696,955 B2 to Kolton et al. describes an EAS marker assembly that comprises a housing defining an interior cavity and an EAS marker and a weighting member disposed in the housing interior cavity, the weighting member being of a composition which does not interfere with operation of the EAS marker. A container has an inlet/outlet pot and an EAS marker assembly is configured to be passable through the inlet/outlet port into an interior of the container and thereupon to expand to a dimension exceeding a dimension of the container inlet/outlet port, the EAS marker assembly including therein a weighting member.

U.S. Pat. No. 6,646,553 B1 to Kolton et al. describes an electrical article surveillance marker assembly that comprises a housing containing an EAS marker and a strap member having a detent structure at one end thereof and a tail extending from the detent structure to a free end, one side of the tail defining ratchet structure retainable by the detent structure, the detent structure being retained interiorly of the housing, the tail extending outwardly of the housing through a passage formed in a first wall of the housing, the housing defining an opening in a second wall of the housing in registry with the detent structure, the tail free end being movable through the second wall opening into the detent structure to be retained in the housing.

U.S. Pat. No. 6,589,067 B1 to Kolton et al. describes an electrical cable assembly that includes an electrical cable and an electrical connector connected to the electrical cable has a housing thereon defining a passage therethrough for the electrical cable and opposed housing ends circumscribing the cable, one of the housing ends being in facing relation to the electrical connector. The housing has an EAS member secured therein aside the housing passage. An article surveillance unit has first and second housing members joined to one another and defining a seam line, one of the first and second housing members defining structure overlapping the seam line.

U.S. Pat. No. 6,567,003 B2 to Kolton et al. describes a seal that includes a first housing member defining a recess and detent structure and a tail having an end thereof secured with the first housing member and extending outwardly of the first housing member, the tail having a securement structure at a free end thereof, the tail securement structure being receivable in the detent structure, an EAS marker disposed in the recess and a second housing member having a compartment therein for retentively containing the first housing member.

U.S. Pat. No. 6,543,261 B2 to Kolton et al. describes an EAS marker that contains seal comprises a housing defining an interior recess seating an EAS marker and a latching structure adjacent to an end of the housing. The housing has a flexible tail extending outwardly thereof and the tail defines a plurality of latching apertures. The housing defines an opening distal from each of the latching structure and the recess and of dimensions permitting entry of a free end of the tail into the housing members. The housing further defines an interior channel permitting movement of the tail over and beyond the EAS marker into the interior of the housing.

U.S. Pat. No. 6,518,888 B1 to Kolton et al. describes an EAS marker assembly that includes a housing defining an interior compartment and at least one channel accessible exteriorly of the housing and extending therethrough, an EAS marker contained in the compartment, and at least one securement member having a body portion and first and second leg portions depending from the body portion configured to be jointly insertable in the channel, the body portion and the leg portions defining a cavity closed at one end by the body portion and open at free ends of the leg portions. A combination includes: eyeglasses having a lens holder and first and second temples pivotally secured to the lens holder and at least one clip having a body portion and leg portions depending from the body portion, the body portion defining a cavity, the first temple being resident in the cavity, a housing defining an interior compartment and at least one channel accessible exteriorly of the housing and extending therethrough, the leg portions of the clip being retentively resident in the channel and an EAS member disposed in the compartment.

U.S. Pat. No. 6,488,531 B1 to Kolton et al. describes an electrical cable assembly that includes an electrical cable and an electrical connector connected to the electrical cable has a housing thereon defining a passage therethrough for the electrical cable and opposed housing ends being in facing relation to the electrical connector. The housing has an EAS member secured therein aside the housing passage. An article surveillance unit has first and second housing members joined to one another and defining a seam line, one of the first and second housing members defining structure overlapping the seam line.

U.S. Pat. No. 6,067,016 to Deschenes et al. describes an EAS marker and method of manufacturing it. In a preferred embodiment, the EAS marker comprises a rigid bottom piece of molded plastic having the shape of an open rectangular box. An elongated resonator is disposed in the bottom piece, the resonator being bowed downwardly about its longitudinal axis. A rigid separator of molded plastic is positioned over the open top of the bottom piece, thereby loosely encasing the resonator in the bottom piece. The foregoing bottom piece, resonator and separator are all positioned within the cavity of a rigid top piece of molded plastic having the shape of an inverted open rectangular box, the separator being press-fit against the interior surface of the top wall of the top piece, the bottom piece being press-fit against the interior surfaces of the side walls and end walls of the top piece. The top wall of the top piece is provided with a recessed area in which a biasing element is disposed, the biasing element being retained in the recessed area by the separator. The separator is shaped to include a projection that extends downwardly beyond the remainder of the bottom surface of the separator, the projection being sized and shaped to contact the top of the resonator only within I circular area approximately 0.1 inch in diameter located in approximately the middle of the resonator. The present invention is also directed to an automated method and apparatus for manufacturing the above EAS marker. In a preferred embodiment, each of the top piece, the bottom piece and the separator is manufactured, by rotary extrusion molding, as part of a continuous web, and the various continuous webs are automatically laminated to one another at nips between pairs of rollers.

U.S. Pat. No. 6,064,306 to Deschenes et al. describes a fastener assembly for use in tagging an article of commerce and in detecting the unauthorized removal of the article from a store or other business establishment. The fastener assembly comprises a plastic fastener comprising an elongated filament having a first end and a second end, a transverse bar disposed at the first end of the elongated filament and a paddle disposed at the second end of the elongated filament. The paddle is shaped to include a recess. The fastener assembly also comprises an electronic article surveillance (EAS) security device which is disposed within the recess of the paddle. A cover is mounted over the recess so as to trap the security device within the paddle. A method of manufacturing the fastener assembly can be accomplished by continuously molding a length of fastener stock to form a plastic fastener having a recess former therein, disposing a security device within the recess of the plastic fastener and mounting a cover over the recess so as to trap the security device within the fastener.

U.S. Pat. No. 5,949,336 to Deschenes et al. describes a fastener assembly for use in tagging an article of commerce and in detecting the unauthorized removal of the article from a store or other business establishment. The fastener assembly comprises a plastic fastener comprising an elongated filament having a first end and a second end, a transverse bar disposed at the first end of the elongated filament and a paddle disposed at the second of the elongated filament. The paddle is shaped to include a recess. The fastener assembly also comprises an electronic article surveillance (EAS) security device which is disposed within the recess of the paddle. A cover is mounted over the recess so as to trap the security device within the paddle. A method of manufacturing the fastener assembly can be accomplished by continuously molding a length of fastener stock to form a plastic fastener having a recess formed therein, disposing a security device within the recess of the plastic fastener and mounting a cover over the recess so as to trap the security device within the fastener.

U.S. Pat. No. 5,717,382 to Cooper describes a device for use in detecting the unauthorized removal of an article of commerce from a store or other business establishment. In one embodiment, the device comprises a fastener of the type constructed for use in attaching a tag to the article of commerce. The fastener includes a first end, a second end and a filament interconnecting the first end and the second end. The first end is shaped to define a cross-bar which can be inserted through the tag and then through the article of commerce. The second end is sized and shaped to prevent the tag from being pulled off the filament. The fastener is made of plastic and includes one or more magnetizable particles embedded therewithin. The particles initially placed in a magnetized state. Consequently, when an article, including the fastener, passes through a magnetic field detector, a signal will be emitted unless the particles have been demagnetized.

United States Patent Application Publication No. 2006/0145873 A1 to Feibelman et al. describes an anti-theft security tag that includes an engagement member and a housing for supporting an electronic article surveillance (EAS) marker. The housing includes a rotating inner core for supporting the engagement member for attachment to the article. The engagement member includes a line for connection to the article and a locking mechanism for securing the first and second ends of the line therein so that the core and the engagement member can rotate together within the housing. In one embodiment, the locking mechanism includes one or more self-crimping members which automatically secure at least one end of the line upon insertion therein. One end of the rotating core may be disposed flush with one end of the housing, so that the consumer cannot twist the line in order to remove the tag.

Notwithstanding the prior art, the present invention is neither taught nor rendered obvious thereby.

SUMMARY OF INVENTION

The present invention is directed to a machine-washable ID label for attachment to a washable item that includes: a) an outer shell for housing an electronic article surveillance element, the outer shell having a first component and a second component, said first component being a hollow component with a top and side walls, said side walls having inside surfaces and outside surfaces and a continuous loop rim, said top having a maximum predetermined inside width, said side walls having a maximum inside height, wherein said maximum inside height is at least 50% greater than said maximum predetermined inside width, said first component having a U-shaped view from a cut side view and from a cut end view, said first component having an outwardly extending male connector on said rim; and, said second component being a hollow component with a bottom and side walls, said walls having inside surfaces and outside surfaces and a continuous loop rim, said bottom having a maximum predetermined inside width, said side walls having a maximum inside height, wherein said a maximum inside height is at least 50% greater than said maximum predetermined inside width, said second component having a U-shaped view from a cut side view and from a cut end view, said second component having an outwardly extending female connector receiver on said rim, wherein said male connector is located in said female connector receiver and said first component and said second component are hermetically sealed to one another so as to render the inside of said outer shell internally waterproof; and b) an electronic article surveillance element positioned within the outer shell so as to render it impermeable to water.

In some preferred embodiments of the present invention machine-washable ID label for attachment to a washable item, the male connector is a continuous loop male connector running the full length of the first component rim the female connector receiver is a continuous loop female connector receiver running the full length of the second component rim.

In some preferred embodiments of the present invention machine-washable ID label for attachment to a washable item, at least one of said male connector and said female connector receiver has at least one surface that is textured for enhancing hermetic sealing by heat welding.

In some preferred embodiments of the present invention machine-washable ID label for attachment to a washable item, the male connector has an inside wall surface that is a continuation of and in the same plane as the inside wall surface of the first component.

In some preferred embodiments of the present invention machine-washable ID label for attachment to a washable item, the female connector receiver has an outside wall surface that is a continuation of and in the same plane as the outside wall surface of the second component.

In some other preferred embodiments of the present invention machine-washable ID label for attachment to a washable item, there is included: a) an outer shell for housing an electronic article surveillance element, the outer shell having a first component and a second component, said first component being a hollow component with a top and side walls, said side walls having inside surfaces and outside surfaces and a continuous loop rim, said top having a maximum predetermined inside width, said side walls having a maximum inside height, wherein said maximum inside height is at least 50% greater than said maximum predetermined inside width, said first component having a U-shaped view from a cut side view and from a cut end view, said first component having an outwardly extending male connector on said rim; and, said second component being a hollow component with a bottom and side walls, said walls having inside surfaces and outside surfaces and a continuous loop rim, said bottom having a maximum predetermined inside width, said side walls having a maximum inside height, wherein said a maximum inside height is at least 50% greater than said maximum predetermined inside width, said second component having a U-shaped view from a cut side view and from a cut end view, said second component having an outwardly extending female connector receiver on said rim, wherein said male connector is located in said female connector receiver and said first component and said second component are hermetically sealed to one another so as to render the inside of said outer shell internally waterproof wherein at least one of said first component and said second component has a heat seal energy director peak; and b) an electronic article surveillance element positioned within the outer shell so as to render it impermeable to water.

In some preferred embodiments of the present invention machine-washable ID label for attachment to a washable item, the male connector is a continuous loop male connector running the full length of the first component rim the female connector receiver is a continuous loop female connector receiver running the full length of the second component rim.

In some preferred embodiments of the present invention machine-washable ID label for attachment to a washable item, at least one of said male connector and said female connector receiver has at least one surface that is textured for enhancing hermetic sealing by heat welding.

In some preferred embodiments of the present invention machine-washable ID label for attachment to a washable item, the male connector has an inside wall surface that is a continuation of and in the same plane as the inside wall surface of the first component.

In some preferred embodiments of the present invention machine-washable ID label for attachment to a washable item, the female connector receiver has an outside wall surface that is a continuation of and in the same plane as the outside wall surface of the second component.

In some preferred embodiments of the present invention machine-washable ID label for attachment to a washable item, the energy director is located on the female connector receiver.

In some preferred embodiments of the present invention machine-washable ID label for attachment to a washable item, the energy director is located on the male connector.

In some preferred embodiments of the present invention machine-washable ID label for attachment to a washable item, the energy director has a peak with an angle of about 30 degrees to about 60 degrees from the surface on which it is located.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 3:
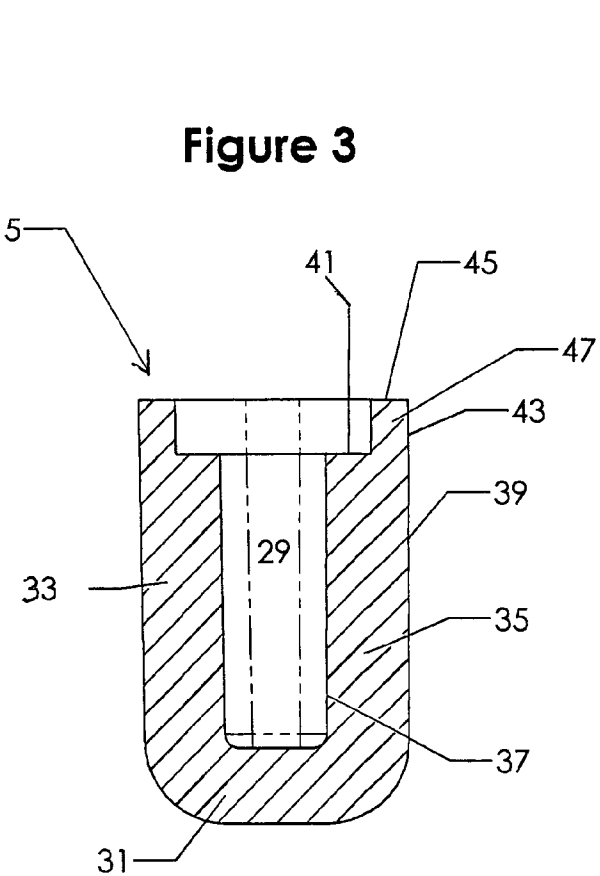
FIG. 3 is a detailed cut side view of the outer shell second component of the present invention machine-washable ID label shown in FIG. 1.

Referring now in detail to the drawings wherein like reference numerals designate corresponding parts throughout the several views, various embodiments of the present invention are shown.

Figure 1:
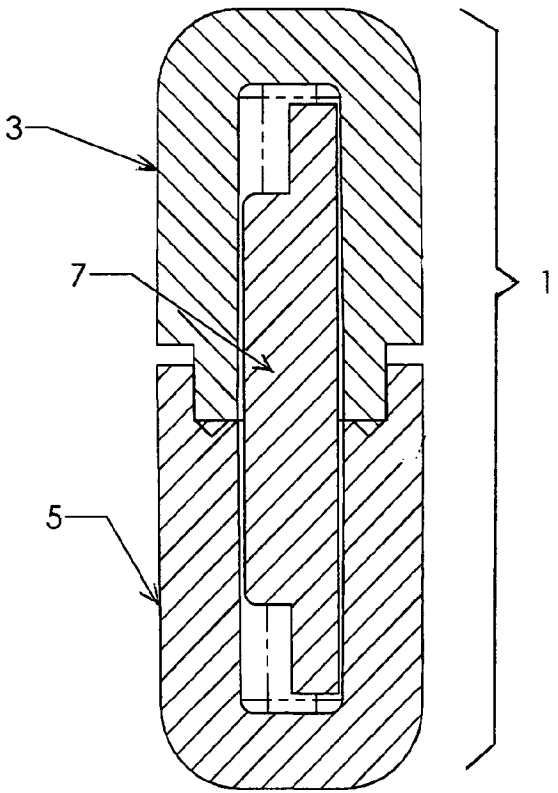
FIG. 1 is a cut side view of an embodiment of a present invention machine-washable ID label for attachment to a washable item.
Figure 4:
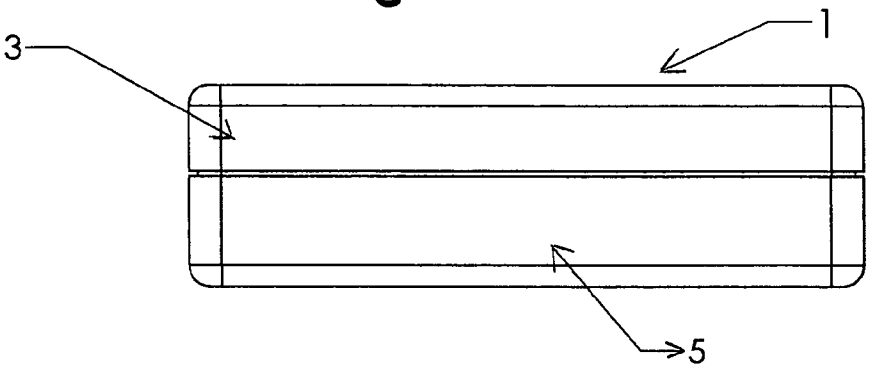
FIG. 4 is a front view of the embodiment of a present invention machine-washable ID label shown in FIG. 1.

FIG. 1 is a cut side view of an embodiment of a present invention machine-washable ID label 1, for attachment to a washable item and FIG. 4 is a front view of the embodiment of the present invention machine-washable ID label 1 shown in FIG. 1. The two figures are described here collectively and common elements are identically numbered. (Not all numerals are shown in both figures. Throughout this application, when figures are discussed collectively and a numeral appears in only one of the two figures, it is understood that the figure containing that numeral is being addressed.) ID label 1 includes an outer shell that is made of two components, namely, first component 3 and second component 5. Hermetically sealed within the outer shell is electronic article surveillance element 7 that is rendered impermeable to water by the uniquely hermetically sealed outer shell.

Figure 2:
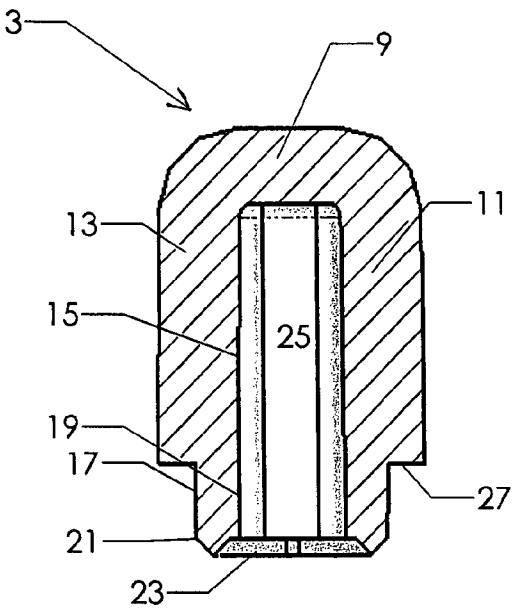
FIG. 2 is a detailed cut side view of the outer shell first component of the present invention machine-washable ID label shown in FIG. 1.
Figure 7:
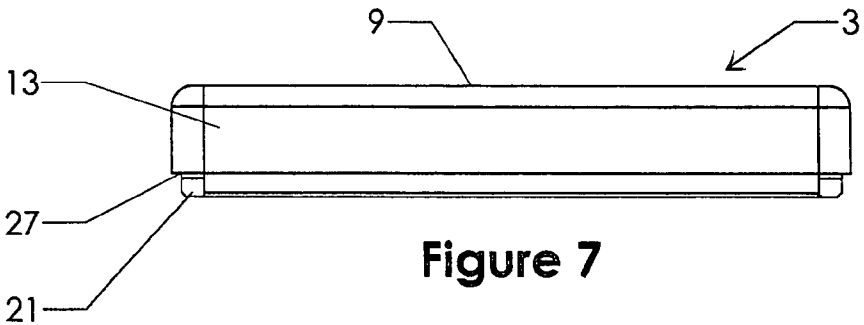
FIG. 7 is a front view of the present invention machine-washable ID label outer shell first component shown in FIG. 2; and, FIG. 8 is a front view of the present invention machine-washable ID label outer shell second component shown in FIG. 3.

FIG. 2 is a detailed cut side view of the outer shell first component 3 of the present invention machine-washable ID label 1 shown in FIG. 1. FIG. 7 is a front view of the present invention machine-washable ID label outer shell first component 3 shown in FIG. 2. These two figures are discussed here collectively and identical parts are identically numbered. First component 3 has a hollow central area 25 with an open bottom, a bottom rim 27, a top 9 and a continuous side wall shown in FIG. 2 as side wall 13. Opposing side wall right portion 11 has the same thickness and features and is hence a mirror image of the left portion. As can be seen from the figure, first component 3 has a U-shape as seen from a cut view. This component 3 has a narrow width and a relatively tall height. In general, the inside height of this component should be at least 50% greater than maximum inside width, so that there is significant wall area to inside top area. (In this preferred embodiment, the inside height is more than 250% of the maximum inside width.) This enables more efficient and tighter placement of the electronic article surveillance element into this component by minimizing air entrapment. It takes less force than if the components were designed or cut vertically (conventionally) instead of horizontally in FIG. 1 and reduces or eliminates air pocket problems so as to assure a reliable hermetic seal.

Extending downwardly and away from (outwardly from) rim 27 is male connector 17. In this preferred embodiment, inside wall surface 15 of the first component 3 is parallel with and in the same plane as inside wall surface 19 of male connector 17. This makes mold design and product release simpler than step down inside walls. At the bottom 21 of male connector 17 is a heat seal energy director peak 23. Peak 23 is preferably, as here, in a continuous loop. This peak 23 works in harmony with the unpeaked component during heat welding of the two shell components.

Figure 8:
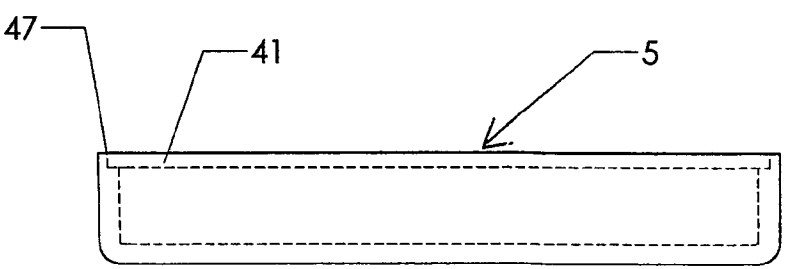

FIG. 3 is a detailed cut side view of the outer shell second component 5 of the present invention machine-washable ID label 1 shown in FIG. 1. FIG. 8 is a front view of the present invention machine-washable ID label outer shell second component 5 shown in FIG. 3. These two figures are discussed here collectively and identical parts are identically numbered. Second component 5 has a hollow central area 29 with an open top, a top rim 41, a bottom 31 and a continuous side wall shown in FIG. 3 as side wall 33. Opposing side wall right portion 35 has the same thickness and features and is hence a mirror image of the left portion. As can be seen from the figure, second component 5 has a U-shape as seen from a cut view. This component 5, similarly to component 3 described above, has a narrow width and a relatively tall height. In general, the inside height of this component should be at least 50% greater than maximum inside width, so that there is significant wall area to inside top area. (In this preferred embodiment, the inside height is more than 250% of the maximum inside width.) Again, this enables more efficient and tighter placement of the electronic article surveillance element into this component by minimizing air entrapment. It takes less force than if the components were designed or cut vertically (conventionally) instead of horizontally in FIG. 1 and reduces or eliminates air pocket problems so as to assure a reliable hermetic seal.

Extending upwardly and away from (outwardly from) rim 41 is female connector receiver 47. Inside wall 37 terminates at rim 41 and the female connector receiver thus creates a receiving recess for receiving male connector 17 (FIG. 2). In this preferred embodiment, outside side wall surface 39 of the second component 5 is parallel with and in the same plane as outside wall surface 43 of female connector receiver 47. as with component 3 above, this makes mold design and product release simpler than step down inside walls. At the top 45 of female connector receiver 47 is a flat continuous loop rim top 45 that will press against and cooperate with heat seal energy director peak 23 (FIG. 2). Peak 23 works in harmony with the unpeaked second component 5 during heat welding of the two shell components. When the electronic article surveillance device 7 (FIG. 1) is placed in the two shell components and they are then closed and hermetically heat sealed, the resulting hermetic heat seal is tighter and stronger than when conventional components are heat sealed.

Figure 6:
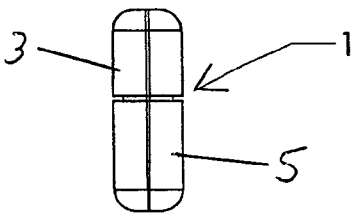
FIG. 6 is a side view of the present invention machine-washable ID label shown in FIG. 1.
Figure 5:
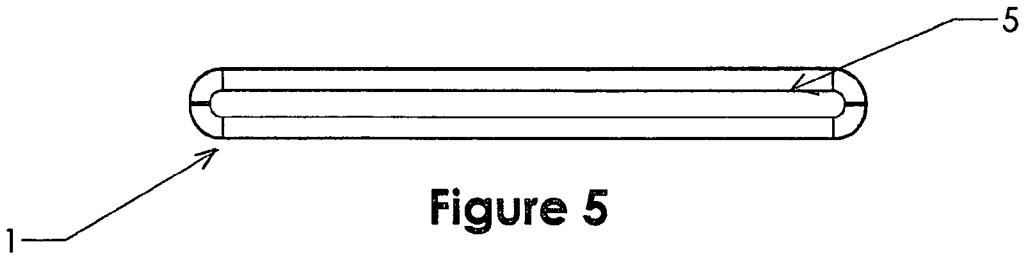
FIG. 5 is a top view of the present invention machine-washable ID label shown in FIG. 1.

FIG. 5 is a top view of the present invention machine-washable ID label 1 shown in FIG. 1, and FIG. 6 is a side view of the present invention machine-washable ID label 1 shown in FIG. 1. Shell second component 5 can be seen in FIG. 5 and both shell first component 3 and shell second component 5 can be seen in FIG. 6.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A machine-washable ID label for attachment to a washable item, which comprises:

a) an outer shell for housing an electronic article surveillance element, said outer shell having a first component and a second component, said first component being a hollow component with a top and side walls, said side walls having inside surfaces and outside surfaces and a continuous loop rim, said top having a maximum predetermined inside width, said side walls having a maximum inside height, wherein said maximum inside height is at least 50% greater than said maximum predetermined inside width, said first component having a U-shaped view from a cut side view and from a cut end view, said first component having an outwardly extending male connector on said rim; and, said second component being a hollow component with a bottom and side walls, said walls having inside surfaces and outside surfaces and a continuous loop rim, said bottom having a maximum predetermined inside width, said side walls having a maximum inside height, wherein said a maximum inside height is at least 50% greater than said maximum predetermined inside width, said second component having a U-shaped view from a cut side view and from a cut end view, said second component having an outwardly extending female connector receiver on said rim, wherein said male connector is located in said female connector receiver and said first component and said second component are hermetically sealed to one another so as to render the inside of said outer shell internally waterproof; and, b) an electronic article surveillance element positioned within said outer shell so as to render it impermeable to water.

2. The machine-washable ID label for attachment to a washable item of claim 1 wherein said male connector is a continuous loop male connector running the full length of said first component rim said female connector receiver is a continuous loop female connector receiver running the full length of said second component rim.

3. The machine-washable ID label for attachment to a washable item of claim 1 wherein at least one of said male connector and said female connector receiver has at least one surface that is textured for enhancing hermetic sealing by heat welding.

4. The machine-washable ID label for attachment to a washable item of claim 2 wherein at least one of said male connector and said female connector receiver has at least one surface that is textured for enhancing hermetic sealing by heat welding.

5. The machine-washable ID label for attachment to a washable item of claim 1 wherein said male connector has an inside wall surface that is a continuation of and in the same plane as the inside wall surface of said first component.

6. The machine-washable ID label for attachment to a washable item of claim 2 wherein said male connector has an inside wall surface that is a continuation of and in the same plane as the inside wall surface of said first component.

7. The machine-washable ID label for attachment to a washable item of claim 1 wherein said female connector receiver has an outside wall surface that is a continuation of and in the same plane as the outside wall surface of said second component.

8. The machine-washable ID label for attachment to a washable item of claim 1 wherein said female connector receiver has an outside wall surface that is a continuation of and in the same plane as the outside wall surface of said second component.

9. A machine-washable ID label for attachment to a washable item, which comprises:

a) an outer shell for housing an electronic article surveillance element, said outer shell having a first component and a second component, said first component being a hollow component with a top and side walls, said side walls having inside surfaces and outside surfaces and a continuous loop rim, said top having a maximum predetermined inside width, said side walls having a maximum inside height, wherein said maximum inside height is at least 50% greater than said maximum predetermined inside width, said first component having a U-shaped view from a cut side view and from a cut end view, said first component having an outwardly extending male connector on said rim; and, said second component being a hollow component with a bottom and side walls, said walls having inside surfaces and outside surfaces and a continuous loop rim, said bottom having a maximum predetermined inside width, said side walls having a maximum inside height, wherein said a maximum inside height is at least 50% greater than said maximum predetermined inside width, said second component having a U-shaped view from a cut side view and from a cut end view, said second component having an outwardly extending female connector receiver on said rim, wherein said male connector is located in said female connector receiver and said first component and said second component are hermetically sealed to one another so as to render the inside of said outer shell internally waterproof, wherein at least one of said first component and said second component has a heat seal energy director peak; and b) an electronic article surveillance element positioned within said outer shell so as to render it impermeable to water.

10. The machine-washable ID label for attachment to a washable item of claim 9 wherein said male connector is a continuous loop male connector running the full length of said first component rim said female connector receiver is a continuous loop female connector receiver running the full length of said second component rim.

11. The machine-washable ID label for attachment to a washable item of claim 9 wherein at least one of said male connector and said female connector receiver has at least one surface that is textured for enhancing hermetic sealing by heat welding.

12. The machine-washable ID label for attachment to a washable item of claim 10 wherein at least one of said male connector and said female connector receiver has at least one surface that is textured for enhancing hermetic sealing by heat welding.

13. The machine-washable ID label for attachment to a washable item of claim 9 wherein said male connector has an inside wall surface that is a continuation of and in the same plane as the inside wall surface of said first component.

14. The machine-washable ID label for attachment to a washable item of claim 10 wherein said male connector has an inside wall surface that is a continuation of and in the same plane as the inside wall surface of said first component.

15. The machine-washable ID label for attachment to a washable item of claim 9 wherein said female connector receiver has an outside wall surface that is a continuation of and in the same plane as the outside wall surface of said second component.

16. The machine-washable ID label for attachment to a washable item of claim 9 wherein said female connector receiver has an outside wall surface that is a continuation of and in the same plane as the outside wall surface of said second component.

17. The machine-washable ID label for attachment to a washable item of claim 9 wherein said energy director is located adjacent said female connector receiver.

18. The machine-washable ID label for attachment to a washable item of claim 9 wherein said energy director is located within said male connector.

19. The machine-washable ID label for attachment to a washable item of claim 17 wherein said energy director has a peak with an angle of about 30 degrees to about 60 degrees from the surface on which it is located.

20. The machine-washable ID label for attachment to a washable item of claim 18 wherein said energy director has a peak with an angle of about 30 degrees to about 60 degrees from the surface on which it is located.

* * * * *